United States Patent [19]

Duri' et al.

[11] Patent Number: 4,879,893

[45] Date of Patent: Nov. 14, 1989

[54] MULTIPURPOSE SWAGING MACHINE

[75] Inventors: Antonino Duri', Pradamano; Geremia Nonini, Buttrio, both of Italy

[73] Assignee: Danieli & C. Officine Mecchaniche SpA, Nazionale, Italy

[21] Appl. No.: 208,043

[22] Filed: Jun. 17, 1988

[30] Foreign Application Priority Data

Jul. 3, 1987 [IT] Italy ..... 83399 A/87

[51] Int. Cl.[4] ..... B21J 7/14

[52] U.S. Cl. ..... 72/402; 72/447; 72/450

[58] Field of Search ..... 72/402, 441, 447, 407, 72/76, 450, 453.01

[56] References Cited

U.S. PATENT DOCUMENTS

| | | | |
|---|---|---|---|
| 3,246,502 | 4/1966 | Brignoli | 72/447 |
| 3,478,565 | 11/1969 | Schenk . | |
| 3,613,432 | 10/1971 | Schenk . | |
| 3,657,916 | 4/1972 | Pahnke . | |
| 3,837,209 | 9/1974 | Guse | 72/402 |
| 4,229,963 | 10/1980 | Savinov et al. | 72/402 |

FOREIGN PATENT DOCUMENTS 1302095 1/1973 United Kingdom .

*Primary Examiner*—Daniel C. Crane

*Attorney, Agent, or Firm*—Wegner & Bretschneider

[57] ABSTRACT

Multipurpose swaging machine to forge elongate semi-finished products, which comprises a plurality of forging units contained in the machine and performing a swaging operation according to a linear movement or a movement along an arc of a circle, each of the forging units including a hammer support element (15) connected on one side to a hammer (12) and on the opposite side to a power ram (14) able to impart to the hammer (12) a movement between a first and a second position, and also including a jack (22) to return the hammer assemblage (11), the machine comprising a lever (18) fitted so as to be able to rotate about a stationary pivot (17) positioned at the side of the hammer support element (15), the lever (18) cooperating with the hammer support element (15) in a method of working according to a linear movement by guiding the hammer support element (15) along a straight path and in a method of working according to a movement along an arc of a circle, the lever (18) being rendered firmly fixed to the hammer support element (15) performing a movement about the stationary pivot (17).

4 Claims, 2 Drawing Sheets

MULTIPURPOSE SWAGING MACHINE

BACKGROUND OF THE INVENTION

This invention concerns a swaging machine suitable to work either according to the movement of a camera shutter or with a straight movement.

Swaging machines are known which have the task of producing forged parts by continuous progressive swaging. Such machines are structured according to the specific movement which characterizes their swaging action.

There are two methods for performing the swaging action; these methods depend on the characteristics which are to be obtained in the finished product.

One type of swaging machine carries out a straight movement and is more suitable to produce simple parts such as square, flat or hexagonal parts, etc.

The other type of swaging machine performs a circular movement, and hammers cooperate with each other like the components of a diaphragm of a shutter, that is to say, each hammer moves according to an arc of a circumference. This type of swaging is more suitable for processing round and cylindrical parts in general.

The text US-A-3,837,209 discloses a multipurpose forging machine according to the preamble of claim 1. This forging machine comprises a main piston able to move in a cylinder and coupled by a thrust pin to a second piston equipped at one end with a ram.

The second piston slides in a guide element pivoted at one side and connected to a pull-back cylinder on the other side.

Moreover, seatings are machined in the guide element and contain third pistons acting on the other end of the second piston.

In the method of working as a ram the second piston is rendered solidly fixed to the guide element by the thrust of the third pistons and therefore a thrust carried out by the first piston is imparted to the ram according to a circular movement.

The pull-back cylinder recalls the ram and therefore the second and first pistons to their initial position.

In the linear working method the pull-back cylinder is actuated until it causes the guide element to abut against a stop provided on the body of the forging machine.

The pull-back cylinder maintains this position and overcomes even the force exerted by the third pistons.

The main piston can therefore exert its own force directly on the second piston that bears the ram.

Return to the initial position is ensured by the third pistons.

This forging maching entails a series of drawbacks and shortcomings due to the following factors:

in the linear working method the unevennesses on the piece to be forged cause recoils of the second piston onto the guide element, these recoils causing swift wear of the second piston and of the guide element, which undergo drawing friction;

the third pistons are contained in seatings provided in the guide element, which is held in the body of the machine and can move during the method of working as a ram.

This entails the inclusion of a series of pipes arriving from outside for the passage of liquid and constantly subjected to considerable dynamic stresses, which result also in breakage of the pipes.

SUMMARY OF THE INVENTION

The present invention has the purpose of obviating the typical drawbacks and shortcomings of the state of the art. This is achieved by a swaging machine of the type disclosed at the beginning of this text and possessing the features described in the characterizing part of claim 1. The dependent claims describe preferred embodiments of the invention.

According to the invention the support of the hammer cooperates with a pair of levers suitable to work, depending on the case in question, either as an arm of a parallelogram or as a rigid structure forming part of the support of the hammer.

A suitable power ram serves to give the hammer the required to-and-fro movement to suit the purpose in question, while jacks to return the hammers are advantageously included.

BRIEF DESCRIPTION OF THE DRAWING

The attached figures, which are given as a non-restrictive example, show the following.

DESCRIPTION OF THE PREFERRED EMBODIMENT

Figure 1:
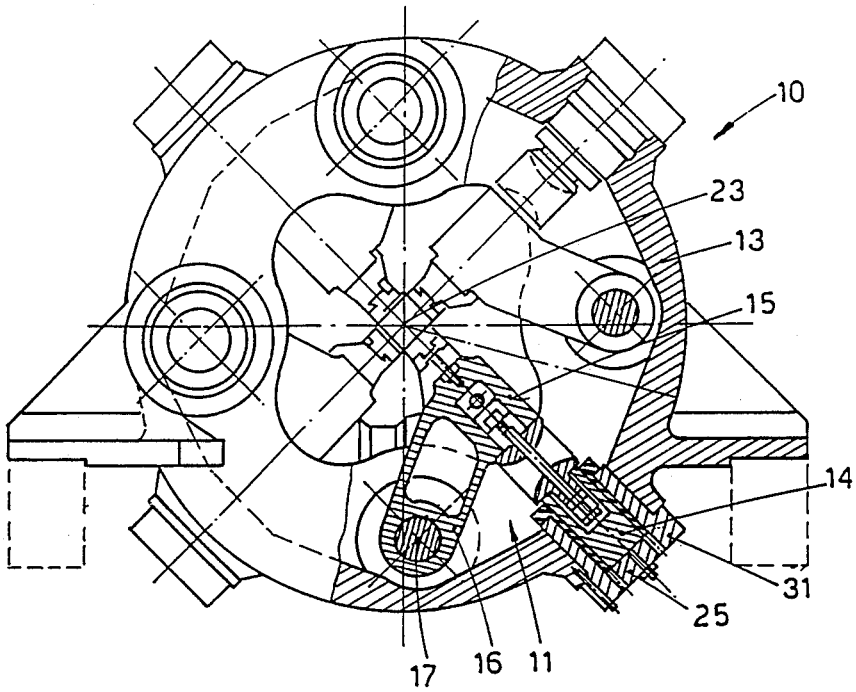
fig.1 PRIOR ART
FIG. 1 shows a swaging machine of a traditional type.

In FIG. 1 a swaging machine 10 with a frame 13 comprises four hammer assemblages 11, which cooperate reciprocally with a centre 23 of a part 28 to be processed.

The hammer assemblage 11 consists, in this example, of a hammer support 15, a power ram 14 and an arm 16 pivoted at a centre of rotation 17.

The power ram 14 consists of a piston 25 cooperating with a cylinder 31.

A hammer 12 rotatable at the centre of rotation 17 follows an arc of a circle which is typical of a shutter-type movement, while the power ram 14 remains substantially still, the piston 25 alone moving axially.

Figure 2A:
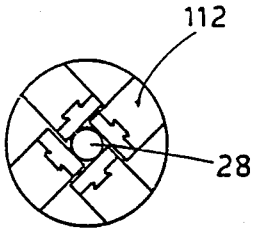
fig.2a PRIOR ART
FIGS. 2*a* and 2*b* show the shutter-type movement and straight movement respectively in swaging operations.
Figure 2B:
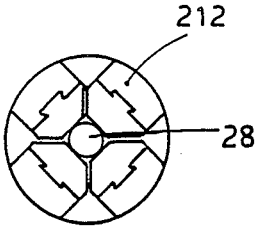
fig.2b PRIOR ART

During the shutter-type movement, the part 28 is processed by cooperating hammers 112 as shown in FIG. 2*a*, whereas during the straight movement the part 28 is processed by hammers 212 cooperating with each other as shown in FIG. 2*b*.

While the hammers may have a substantially straight hammering surface during the shutter-type movement even when swaging a round bar, they must of necessity have a specially shaped surface during the straight movement when they are required to swage round bars smaller than certain dimensions.

According to a first embodiment of the invention the ram 14, which substantially comprises a cylinder 31 and piston 25, is provided in the frame 13.

Figure 3:
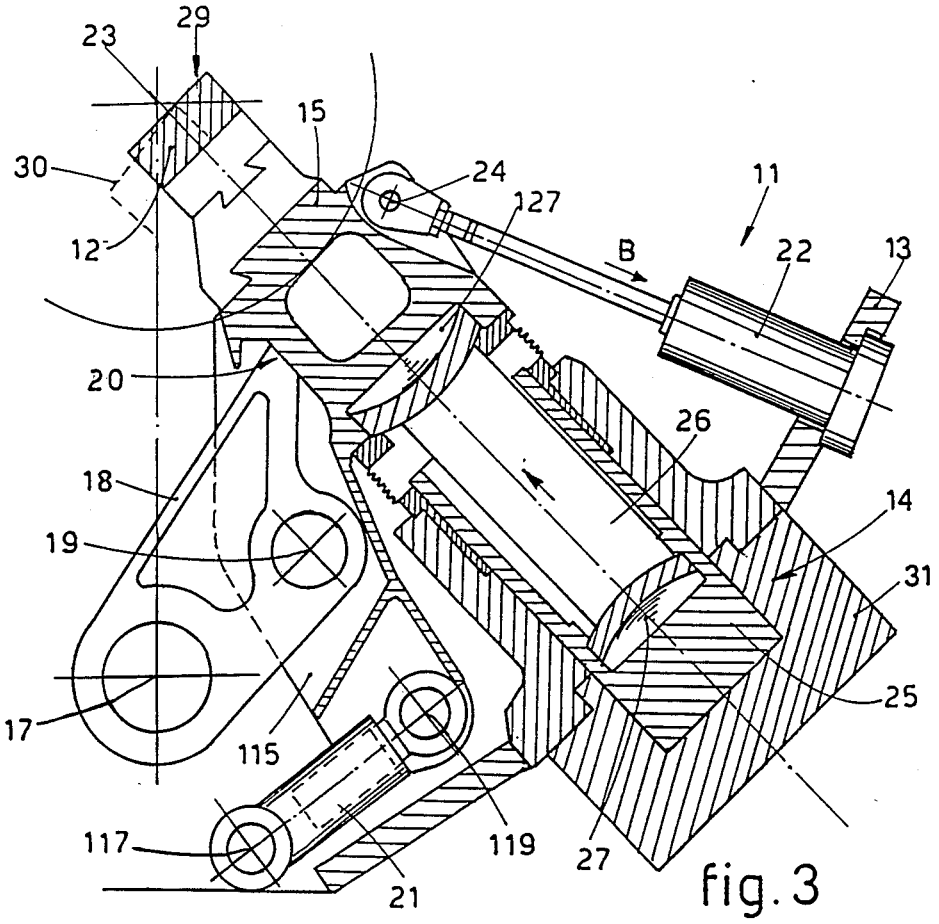
FIG. 3 shows a preferred embodiment of the invention.

In the example of FIG. 3 the piston 25 comprises a first compensation half-sphere 27 which cooperates with a connecting rod 26 that transmits movement to a second compensation half-sphere 127 which in turn cooperates with the support 15 that bears the hammer 12.

At the end of its travel the hammer 12 may take up one of two positions, respectively position 29 in the case of straight movement or position 30 in the case of a shutter-type movement.

A lever 18 with an arm and a first jack 21 which converts the movement of the swaging assemblage are employed to obtain the above movements.

The lever 18 has a centre of application 19 cooperating with an extension 115 of the hammer support 15 and a centre of rotation 17 cooperating with the frame 13.

The first jack 21 also cooperates with a centre of application 119 comprised on the extension 115 of the hammer support 15 and with a centre of rotation 117 on the frame 13. Both the center of application 119 and the center of rotation 117 can be secured by pin or analogous means.

Moreover, the lever 18 comprises an abutment surface 20 suitable to rest in a required and firm manner on a respective abutment surface comprised on the hammer support 15. The abutment surface 20 is positioned at the side of the directrix joining the centre of application 19 and centre of rotation 17 of the lever 18.

The example illustrated shows a displacement towards the hammer 12, and the description refers to this specific embodiment.

A second jack 22 for return of the assemblage cooperates with the hammer support 15 and comprises a centre of application 24 on the hammer support 15 itself and is solidly fixed to the frame 13.

When it is necessary for the hammer assemblage 11 to process with a straight movement, with the position shown of the abutment surface 20 the first jack 21 is fully retracted, and the lever 18 and first jack 21 act as levers of a parallelogram cooperating with the hammer support 15.

Thus the action of the ram 14 is a linear action which is applied in a linear manner to the hammer support 15, which also moves forwards in a linear manner, being carried in a linear direction by the parallelogram consisting of the lever 18 and first jack 21.

The second return jack 22 serves to reposition the hammer support 15 after every swaging action performed by the ram 14.

Instead, when it is necessary to make the hammer 12 work with a shutter-type movement, the first jack 21 is thrust forwards when the abutment surface 20 is positioned as in FIG. 3.

This forward thrust has the effect that the centre of application 119 of the first jack 21 tends to be distanced further from the centre of rotation 117 of the first jack 21, thus compelling the abutment surfaces 20 of the lever 18 and hammer support 15 respectively to cooperate in a firm and close manner with rotation at the centre of application 19 of the lever 18.

In this way the assemblage of the lever 18 and first jack 21 no longer forms a parallelogram. Instead, the hammer support 15 becomes solidly connected to the lever 18 through the abutment surface 20 and rotates with the lever 18 about the centre of rotation 17 of the lever 18.

In this way the movement imparted to the hammer support 15 by the ram 14 is converted into movement along an arc of a circle of which the axis of rotation is the centre of rotation 17 of the lever 18.

Thus, the action of the first jack 21 to contact abutment surface 20 against the respective abutment surface of the hammer support results in a transient reciprocal connection in which both shutter-type and linear movement can be easily achieved.

A locking pin or other suitable means may be provided instead of the abutment surface 20.

We claim:

1. Multipurpose swaging machine comprising a hammer assembly and a return jack for repositioning the hammer assembly, wherein the hammer assembly includes a hammer support element, a power ram and a hammer, the improvement comprising:

(a) a first lever rotatably fixed to a side of the hammer support element, and (b) an extendable first jack rotatably fitted to the same side of the hammer support element as the first lever, wherein the first jack, in an unextended position, forms a parallelogram with the first lever such that the first jack and first lever act to impart linear movement to the hammer assembly, and the first jack, in an extended position, acts with the first lever to impart hammer assembly movement along an arc of a circle.

2. Machine according to claim 1, wherein the first lever and first jack are rotatably fitted to the side of the hammer support by pin means.

3. Machine according to claim 1, wherein the first lever and the hammer support include abutment surfaces that rest upon one another when the first jack is in the extended position.

4. Machine according to claim 1, wherein the side of the hammer support element is an extension of the hammer support element.

* * * * *